United States Patent [19]

Forester

[11] Patent Number: 4,775,458

[45] **Date of Patent: * Oct. 4, 1988**

[54] MULTIFUNCTIONAL ANTIFOULANT COMPOSITIONS AND METHODS OF USE THEREOF

[75] Inventor: David R. Forester, The Woodlands, Tex.

[73] Assignee: Betz Laboratories, Inc., Trevose, Pa.

[ * ] Notice: The portion of the term of this patent subsequent to Mar. 25, 2003 has been disclaimed.

[21] Appl. No.: 944,159

[22] Filed: Dec. 18, 1986

[51] Int. Cl.[4] ..... C10G 9/12; C10G 9/16

[52] U.S. Cl. ..... 208/48 AA; 208/48 R; 585/950; 252/34.7; 252/46.7; 252/389.2; 252/389.21; 252/389.24

[58] Field of Search ..... 208/48 R, 48 AA; 585/950; 252/34, 34.7, 46.7, 389.2, 389.21, 389.24

[56] References Cited

U.S. PATENT DOCUMENTS

| | | | |
|---|---|---|---|
| 2,316,080 | 4/1943 | Loane et al. | 252/46.4 |
| 2,316,082 | 4/1943 | Loane et al. | 252/46.4 |
| 2,352,164 | 6/1944 | Burnham et al. | 208/48 AA |
| 2,785,128 | 3/1957 | Popkin | 252/32.7 |
| 3,024,277 | 3/1962 | Hotten | 208/48 AA |
| 3,105,810 | 10/1968 | Miller | 208/48 |
| 3,123,630 | 3/1964 | Oberender et al. | 260/461 |
| 3,135,729 | 6/1964 | Kluge et al. | 260/139 |
| 3,162,671 | 12/1964 | Petersen et al. | 260/461 |
| 3,201,438 | 8/1965 | Reed | 260/461 |
| 3,217,296 | 9/1966 | Gonzalez | 208/48 |
| 3,271,295 | 9/1966 | Gonzalez | 208/48 |
| 3,281,359 | 10/1966 | Oberender et al. | 252/46.6 |
| 3,301,923 | 1/1967 | Skovronek | 260/953 |
| 3,364,130 | 1/1968 | Barnum et al. | 208/48 AA |
| 3,405,054 | 10/1968 | Arkis | 208/48 |
| 3,412,029 | 11/1968 | Andress, Jr. et al. | 208/48 AA |
| 3,437,583 | 4/1969 | Gonzalez | 208/48 |
| 3,442,791 | 5/1969 | Gonzalez | 208/48 |
| 3,449,424 | 6/1969 | Andress, Jr. | 208/48 AA |
| 3,483,133 | 12/1969 | Hatch et al. | 208/48 AA |
| 3,489,682 | 1/1970 | LeSuer | 252/32.7 |
| 3,492,219 | 1/1970 | Miller | 208/48 AA |
| 3,546,097 | 12/1970 | Tupper | 208/48 AA |
| 3,567,623 | 3/1971 | Hagney | 208/48 |
| 3,776,835 | 12/1973 | Dvoracek | 208/48 AA |
| 3,800,002 | 3/1974 | Chikatsu et al. | 208/48 AA |
| 4,024,048 | 5/1977 | Shell | 208/48 AA |
| 4,024,049 | 5/1977 | Shell | 208/48 |
| 4,024,051 | 5/1977 | Shell | 208/187 |
| 4,105,540 | 8/1978 | Weinland | 208/48 AA |
| 4,107,030 | 8/1978 | Slovinsky et al. | 208/48 AA |
| 4,542,253 | 9/1985 | Kaplan et al. | 208/48 AA |
| 4,578,178 | 3/1986 | Forester | 585/950 |
| 4,619,756 | 10/1986 | Dickakian | 208/48 AA |

FOREIGN PATENT DOCUMENTS

| | | | |
|---|---|---|---|
| 1205768 | 6/1986 | Canada | 208/48 AA |

*Primary Examiner*—H. M. Sneed
*Assistant Examiner*—Helane Myers
*Attorney, Agent, or Firm*—Alexander D. Ricci; Bruce E. Peacock

[57] ABSTRACT

Multifunctional process antifoulant compositions and methods are disclosed. The compositions comprise (1) a polyalkenylthiophosphonic acid or ester thereof, and at least one additional antifouling component selected from the groups (2), (3) and (4) wherein (2) is an effective antioxidant compound adapted to inhibit oxygen based polymerization of said hydrocarbon or petrochemical, (3) is a corrosion inhibiting compound, and (4) is a metal deactivator. The process comprises adding from about 0.5–10,000 parts of the combination of (1) and additional antifoulant component(s) to the particular petrochemical or hydrocarbon for which multifunctional antifouling protection is desired.

21 Claims, No Drawings

MULTIFUNCTIONAL ANTIFOULANT COMPOSITIONS AND METHODS OF USE THEREOF

FIELD OF THE INVENTION

The present invention pertains to compositions and methods for providing antifouling protection for petroleum hydrocarbons or petrochemicals during processing thereof at elevated temperatures. The compositions and methods also serve to deactivate metals in contact with the aforementioned process streams, inhibit oxidation of the process fluid, and inhibit corrosion of the metallurgy in contact with the process fluid.

BACKGROUND

In the processing of petroleum hydrocarbons and feedstocks such as crude oil and petroleum processing intermediates, and petrochemicals and petrochemical intermediates, e.g., gas, oils and reformer stocks, chlorinated hydrocarbons and olefin plant fluids such as deethanizer bottoms the hydrocarbons are commonly heated to temperatures of 100° to 1000° F. Similarly, such petroleum hydrocarbons are frequently employed as heating mediums on the "hot side" of heating and heat exchange systems such as vacuum tower bottoms and slurry systems. In both instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shutdowns for cleaning. Moreover these deposits reduce throughput, which of course, results in a loss of capacity with a drastic effect in the yield of finished product. Accordingly, these deposits have caused considerable concern to the industry.

Organic foulants are usually higher molecular weight materials ranging in consistency from that of tar to rubber to "popcorn" to "coke". The exact composition of such foulants is difficult to identify.

One particularly troublesome type of organic fouling is caused by the formation of polymers that are insoluble in the hydrocarbon or petrochemical fluid being processed. The polymers are usually formed by reactions of unsaturated hydrocarbons, although any hydrocarbon can polymerize. Generally, olefins tend to polymerize more readily than aromatics, which in turn polymerize more readily than paraffins. Trace organic materials containing hetero atoms such as nitrogen, oxygen and sulfur also contribute to polymerization.

Polymers are formed by free radical chain reactions. These reactions, shown below, consist of two phases, an initiation phase and a propagation phase. In reaction 1, the chain initiation reaction, a free radical represented by R•, is formed (the symbol R can be any hydrocarbon). These free radicals, which have an odd electron, act as chain carriers. During chain propagation, additional free radicals are formed and the hydrocarbon molecules (R) grow larger and larger (see reaction 2c), forming the unwanted polymers which accumulate on heat transfer surfaces.

Chain reactions can be triggered in several ways. In reaction 1, heat starts the chain. Example: when a reactive molecule such as an olefin or a diolefin is heated, a free radical is produced. Another way a chain reaction starts is shown in reaction 3. Here metal ions initiate free radical formation. Accelerating polymerization by oxygen and metals can be seen by reviewing reactions 2 and 3.

1. Chain Initiation $R—H \rightarrow R^{\bullet} + H$

2. Chain Propagation a. $R^{\bullet} + O_2 \rightarrow R—O—O^{\bullet}$ b. $R—O—O^{\bullet} + R'—H \rightarrow R'^{\bullet} + R—O—O—H$ c. $R^{\bullet} + C{=}C \rightarrow R—C—C^{\bullet} \rightarrow$ polymer 3. Chain Initiation a. $Me^{++} + RH \rightarrow Me^{+} + R^{\bullet} + H^{+}$ b. $Me^{++} + R—O—O—H \rightarrow Me^{+} + R—O—O^{\bullet} + H^{+}$ 4. Chain Termination a. $R^{\bullet} + R'^{\bullet} \rightarrow R—R'$ b. $R^{\bullet} + R—O—O^{\bullet} \rightarrow R—O—O—R$ Research indicates that even very small amounts of oxygen can cause or accelerate polymerization. Accordingly, to inhibit this insidious fouling problem, it is highly desirable to provide a polyfunctional process antifoulant which can, among other functions, inhibit oxygen based polymerization initiation. This antioxidant function serves as a "chain-stopper" by forming inert molecules with the oxidized free radical hydrocarbons, in accordance with the following reaction:

Chain Termination $$ROO^{\bullet} + \text{Antioxidant} \rightarrow ROOH + \text{Antioxidant}^{\bullet}(—H)$$

In addition to the desirability of inhibiting oxygen based polymerization, it is highly desirable to inhibit the catalytic formation of gums and other deposits, which are caused by metallic impurities, such as copper and/or iron, which may be present in the process fluids. These types of antifoulants are referred to as "metals coordinators" or "metal deactivators" and function by the formation of a complex or ligand with the metallic impurity in the process fluid.

Unlike organic deposits, inorganic deposits can be simple to identify. One example is ammonium chloride formed as the reaction product of injected ammonia in a crude overhead system. Other inorganic deposits include e.g., metallic salts, oxides, sulfides, etc. of iron, copper and vanadium. Such deposits may be present in the original feed as "ash" or they may be the result of corrosion or precipitation in equipment where fouling is evident. In some cases, fouling and corrosion may be related in that solving the corrosion problem which exists upstream may improve the downstream fouling problem.

As to the problem of corrosion, the root of this problem is usually attributed to HCl or $H_2S$ contamination of the aqueous phase that is entrained in the process fluid. Other acids such as carbonic acid may also exacerbate the corrosion problem.

Corrosive attack on the metals normally used in the low temperature sections of a refinery processing system, i.e., where water is present below its dew point, is an electrochemical reaction, generally in the form of acid attack on active metals as shown in equation 1.

$$\text{At the anode } Fe \longrightarrow Fe^{++} + 2(e) \quad (1)$$

-continued $$\text{At the cathode } 2H^{+} + .2(e) \longrightarrow 2H \quad (2)$$

$$2H \longrightarrow H_2 \quad (2a)$$

Equation 2 expresses the reduction of hydrogen ions to atomic hydrogen. The rate of the cathodic reaction generally controls the overall corrosion rate.

The aqueous phase is simply water entrained in the hydrocarbons being processed and/or water added to the process for such purposes as steam stripping. Acidity of the condensed water is due to dissolved acids in the condensate, principally HCl and $H_2S$. The HCl is formed by hydrolysis of calcium and magnesium chlorides originally present in the brines produced concomitantly with the hydrocarbons—oil, gas, condensates.

The bulk of these brines is separated at the field production facilities. Most of what remains after field separation is removed by desalting equipment at the refinery, upstream of the crude still and subsequent processing units.

Even under the best of conditions, however, a small amount of salt, several pounds per thousand barrels of charge (ptb expressed as NaCl) will reach the crude still. A portion of this, principally the chlorides of calcium and magnesium, decompose to give gaseous HCl which dissolves in overhead condensates and forces the pH down as low as 2 to 3, which is severely corrosive to steel equipment. With sour crudes, an additional corrodent is $H_2S$, either originally present in the sour oil, gas or condensate production and/or formed at processing temperatures by decomposition of sulfur compounds in the charge stocks. Certain sulfur compounds, such as low-molecular- weight, water-soluble mercaptans may also be corrodents.

There are many areas in the hydrocarbon processing industry where antifoulants have been used successfully; the main treatment areas are discussed below.

In a refinery, the crude unit has been the focus of attention, primarily because fuel use directly impacts on processing costs. Antifoulants have been successfully applied at the exchangers; downstream and upstream of the desalter, on the product side of the preheat train, on both sides of the desalter makeup water exchanger and at the sour water stripper.

Hydrodesulfurization units of all types experience preheat fouling problems. Among those that have been successfully treated are reformer pretreaters processing both straight run and coker naphtha, desulfrizers processing catalytically cracked and coker gas oils, and distillate hydrotreaters. In one case, fouling of a Unifiner stripper column was solved by applying a corrosion inhibitor upstream of the problem source.

Unsaturated and saturated gas plants (refinery vapor recovery units) experience fouling in the various fractionation columns, reboilers and compressors. In some cases, a corrosion control program along with the antifoulant program gave the best results. In other cases, antifoulants alone were enough to solve the problem.

Cat cracker preheat exchanger fouling, both at the vacuum column and at the cat cracker itself, has also been corrected by the use of antifoulants.

In heavy oil treating and cracking units, fouling of preheat trains of the vacuum tower bottoms feedstock has been successfully reduced by antifoulants.

In petrochemical plants, the two most prevalent areas for fouling problems are ethylene and styrene plants. In an ethylene plant, the furnace gas compressors, the various fractionating columns and reboilers are subject to fouling.

In butadiene plants, absorption oil fouling and distillation column and reboiler fouling have been corrected with various types of antifoulants.

Chlorinated hydrocarbon plants, such as VCM, EDC and perchloroethane and trichloroethane have also experienced various types of fouling problems.

The present invention is directed toward multifunctional antifoulant methods and compositions which are useful in controlling fouling encountered in the petroleum and petrochemical systems aboveidentified. More specifically, these compositions and methods, due to their multifunctional characteristics, may be applied effectively to inhibit fouling caused by oxygen-based free radical formation, metal catalysis, corrosion and polymer aggregation.

SUMMARY OF THE INVENTION

In accordance with the invention, multifunctional process antifoulants and compositions are provided. The compositions comprise: (1) as a basic antifoulant component, a polyalkenylthiophosphonic acid, alcohol/polyglycol ester of such polyalkenylthiophosphonic acid, or alkaline earth or amine salt thereof, and an additional antifouling component(s) comprising a member of members of the groups (2), (3), and (4) wherein (2) is an antioxidant compound adapted to inhibit oxygen based polymerization in petrochemical or hydrocarbon process streams, such as the phenylenediamine antioxidants, (3) is a corrosion inhibition agent, such as a tetrahydropyrimidene compound, and (4) is a metal deactivator compound.

PRIOR ART

Use of polyalkenylthiophosphonic acids as process stream antifoulants is disclosed in U.S. Pat. No. 3,405,054 (Arkis et al). Further, certain polyalkenylthiophosphonic acid compounds and certain alcohol and glycol esters thereof are disclosed in U.S. Pat. No. 3,281,359 (Oberender et al) as being useful "detergent-dispersant additives in lubricating oil, particularly petroleum lubricating oil" see Col. 1, lines 20–21. In contrast, the present invention utilizes these compounds to inhibit fouling in petroleum hydrocarbons or petrochemicals and studies have shown that many compoundsknown to be useful as lubricating oil detergent-dispersants do not adequately function as process antifoulants.

Alkaline earth metal salts of hydrocarbon thiophosphonic acids and the use of such salts in the formation of premium motor oils is disclosed in U.S. Pat. No. 3,135,729 (Kluge et al.).

Of somewhat lesser interest is thought to be U.S. Pat. No. 3,123,160 (Oberender et al) which relates to a process for preparing monohydroxyalkyl hydrocarbyl thiophosphonates by reacting hydrocarbyl thiophosphonic acids with alkylene oxides in the absence of a catalyst.

Other patents which may be of interest to the present invention include: U.S. Pat. No. 4,024,051 (Shell) disclosing the use of inorganic phosphorus containing acid compounds and/or salts thereof as antifoulants; U.S. Pat. No. 3,105,810 (Miller) disclosing oil soluble alkaryl sulfur containing compounds as antifoulants; U.S. Pat. No. 4,107,030 (Slovinsky et al) disclosing sulfanilic acid amine salt compounds as antifoulants; U.S. Pat. No.

3,489,682 (Lesuer) disclosing methods for preparing metal salts of organic phosphorus acids and hydrocarbon substituted succinic acids; and U.S. Pat. No. 2,785,128 (Popkin) disclosing methods for preparing metal salts of acidic-phosphorus-containing organic compounds.

U.S. Pat. Nos. 3,437,583 (Gonzalez); 3,567,623 (Hagney); 3,217,296 (Gonzalez); 3,442,791 (Gonzalez); and 3,271,295 (Gonzalez); 3,201,438 (Reed); 3,301,923 (Skovronek); 3,489,682 (Lesuer); 4,024,049 (Shell); and 4,105,540 (Weinland) may also be mentioned as being of possible interest.

DETAILED DESCRIPTION OF THE PRESENT INVENTION

The use of polyalkenylthiophosphonic acids and alcohol/ polyglycol esters therof as process antifoulants is disclosed in U.S. Pat. No. 4,578,178 (Forester), of common assignment herewith. As the present invention utilizes these particular acids and/or salts and esters thereof as the basic antifoulant component (1) of the multifunctional compositions and related processes, the invention herein is viewed as being an improvement over the Forester U.S. Pat. No. 4,578,178.

Preparative routes for synthesizing the component (1) polyalkenylthiophosphonic acids and alcohol/-glycol esters may be seen in aforementioned Forester U.S. Pat. No. 4,578,178, the entire content of which is hereby incorporated by reference. These polymers may be prepared by reacting alkenyl polymers such as polyehtylene, polyproplyene, polyisopropylene, polyisobutylene, polybutene or copolymers comprising such alkenyl repeat unit moieties with $P_2S_5$ (at about 5–40 wt percent of the reaction mass) at a temperature of from about 100° to about 320° C. in the presence of between about 0.1–5.0 wt percent sulfur.

The resulting reaction mixture is then diluted with mineral oil and is then steam hydrolyzed. If desired, the hydrolyzed polyalkenyl—$P_2S_5$ reaction product may then be esterified, by further reaction with lower alkyl ($C_1$–$C_5$) alcohols such as methanol, ethanol, propanol, butanol etc. or with a polyglycol such as hexylene glycol or pentaerythritol.

It is highly desirable to employ, as a precursor material, an alkenyl polymer having an average molecular weight of between about 600 and 5,000.

At present, the reaction product preferred for use as the basic antifouling component (1) of the invention is the pentaerythritol ester of polyisobutenylthiophosphonic acid. This particular ester is commercially available and is hereinafter referred to as PETPA. The polyisobutenyl moiety of PETPA has been reported as having an average molecular weight of about 1300.

PETPA is prepared by mixing polyisobutene (average molecular weight of 750–2000) with $P_2S_5$ (polybutene—$P_2S_5$ molar ratio of 0.9–1.25) in the presence of sulfur at 300°–600° F. until the reaction product is soluble in n-pentane. The product is diluted with paraffin base distillate, steamed for 4–10 hours at 350°–375° F., then dried with $N_2$ at 350°–375° F. The product is extracted with 50–100% by volume of methanol at 75°–150° F. to leave a lubricating oil raffinate containing a polyisobutenylthiophosphonic acid. This material is reacted with pentaerythritol to yield PETPA.

As reported in the Forester U.S. Pat. No. 4,578,178, the hexylene glycol ester of polyisobutenylthiophosphonic acid was prepared as follows:

330 g. of polyisobutenylthiiophosphonic acid (0.1 mole), (MW of isobutenyl moiety ≈ 1300) 11.8 g. of hexylene glycol (0.1 mole) and 100 g. of xylene were added to a 500 mL reaction kettle equipped with thermometer, traps, condenser and drying tube. The mixture was slowly heated to reflux (≈ 150° C.) and maintained for about two hours. After this, the temperature was slowly increased. Between about 138°–176° C., liquids starting to condense in the traps leaving hexylene glycol ester of polyisobutenyltiophosphonic acid (HGETPA) in the flask. This product was analyzed for residual alcohol and none was detected.

As also reported in the Forester U.S. Pat. No. 4,578,178, the n-butanol ester of polyisobutenylthiophosphonic acid was prepared in accordance with the following:

330 g. of polyisobutenylthiophosphonic acid (0.1 mole), (MW of isobutenyl moiety ≈ 1300) 7.4 g. n-butanol (0.1 mole) and 100 g. xylene were added to a 500 mL reaction kettle equipped with thermometer, traps, ice condenser, and drying tube.

The mixture was heated to reflux slowly over about a two hour period. Condensates were caught in the trap, with the resulting n-butanol ester of polyisobutenyltiophosphonic acid (BETPA) remaining in the reaction kettle. This product was analyzed for residual alcohol and none was detected.

In addition to use of the acids and the alcohol/polyglycol esters thereof as the basic antifouling component (1), alkaline earth metal salts of the acids and amine addition salts of the acids may also be noted as having utility. In this respect, alkaline earth elements (or compounds comprising such elements) such as Ca, Mg, Sr, or Ba are reacted with the desired polyalkenylthiophosphonic acid in accordance with conventional techniques. The chlorides, hydroxides, oxides, and carbonates of these alkaline earth metals, preferably the calcium salts, may be reacted with the acid to form the desired salts.

Amine addition salts of the polyalkenylthiophosphonic acids can also be used as the (1) antifouling component. These salts are prepared by conventional techniques. Exemplary amine components include hydroxylamines, such as triethanolamine; fatty amines, such as coco or tallow amines; polyglycolamines, such as tetraoxypropoxylated ethylemeamine; polyamines such as polyethylenediamine; and primary, secondary and tertiary alkyl amines.

Additional antifouling components may comprise and antioxidant component (2). Any antioxidnt compound adapted to inhibit oxygen based polymerization in petrochemical or hydrocarbon process streams may be included.

Exemplary antioxidant components (2) include:

(1) phenylenediamine compounds such as N-phenyl-N'(1,3-dimethylbutyl)-p-phenylenediamine, N-phenyl-N'(1,4-dimethylpentyl)-p-phenylenediamine, or N-phenyl-N'(1, 4-dimethylpropyl)-p-phenylenediamine;

(2) phenolics such as ortho-tert-butyl-para-methoxyphenol, cresylic acid, aminophenol, 2,6-ditertiarybutylphenol, or 4,4' methylenebis-(2,6-ditertiarybutylphenol);

(3-quinones such as tertiary butyl catechol, benzoquinone, tetrabutyl hydroquinone and the like;

(4) alkaline earth salts of alkylphenol sulfides, such as calcium or magnesium sulfurixed phenates;

(5) sulfur/amine containing materials such as phenothiazine and alkylated derivatives or sulfur/phosphorus containing materials such as metal or amine salts of dialkyl dithiophosphoric acids.

Also, additional antifoulant components may comprise a corrosion inhibiting compound (3). The following corrosion inhibiting compounds (3) are exemplary:

(1) substituted amines such as tetrahydropyrimidene, imidazolines, alkylene polyamines and the like;

(2) corrosion inhibiting reaction products obtained by a) reacting at least one alkylene polyamine with a sufficient quantity of at least one aliphatic carboxylic acid to produce a salt of said amine and acid, said salt being of such nature that the amine reactant is decharacterized to the extent that the likelihood of an amine—aldehyde condensation polymerization is substantially eliminated and (b) reacting the salt with a lower aldehyde. See U.S. Pat. No. 3,567,623-especially preferred is the reaction product of $CH_3(CH_2)_{17}$—NH—$(CH_2)_3$—$NH_2$, a tall oil head, and paraformaldehyde—see Example 1 of U.S. Pat. No. 3,567,623;

(3) alkaline earth (Group 2) metal salts of oil-soluble alkyl benzene sulfonic acids, such as magnesium or calcium sulfonates;

(4) amine salts of oil-soluble alkyl naphthalene sulfonic acids, such as the ammonium or ethylenediamine sulfonates;

(5) 2,5-dimercapto-1,3,4-thiadiazole and derivatives;

(6) ethoxylated or propoxylated derivatives of alkyl phenols.

The multifunctional antifoulant may also comprise a fourth component (4) compound adapted to deactivate metals such as copper and iron which would otherwise catalyze polymerization of impurities in the petrochemical or hydrocarbon, leading to gums and deposit formation. Exemplary metal deactivators comprise:

(1) N,N'-disalicylidene-1,2-cyclohexanediamine;

(2) sodium N,N'-ethylenebis(2,5-sodium sulfocarbolate) glycinate;

(3) 2,5-dimercapto-1,3,4-thiadiazole derivatives;

(4) reaction products of alkylphenol, aldehyde, and polyamine such as nonylphenol, formaldehyde and ethylenediamine; optionally, dialkyl or alkoxy phenols may be used.

Accordingly, the multifunctional antifoulant compositions and methods comprise compound (1) and an additional antifouling component(s) selected from the group consisting of compounds defined by the numbers (2), (3), and (4), supra. The weight ratio of (1):additional antifouling components may be on the order of 20–99.7% (1):.3–80% additional antifouling components (i.e., 2, 3, 4) with the weight percentage equalling 100 wt %. An even more preferred range of (1): additional antifouling components is 50–99.7%:.3–50 wt %. When all four components are present, the weight ratio of components (1):(2): (3):(4) in the solvent may be from about 20–99.7:0.1–25:0.1–45:0.1–10. The compositions may be dissolved in a non-polar solvent such as aromatic naphtha or any suitable refined hydrocarbon for the purpose of providing an injectable antifoulant formulation.

The compositions may be used in any of the environments described hereinabove in the "Background" to aid in solving or preventing the particular fouling problems therein described. Generally, they are fed to the process fluid in amount of from about 0.5–10,000 ppm total actives (1, 2, 3 and 4) based upon one million parts petroleum hydrocarbon or petrochemical. Preferably, the multifunctional antifoulant compositions are added in an amount of from about 1 to 1000 ppm total actives (1, 2, 3, and 4). It is noted that at least one of the components 2, 3, and 4 must be conjointly used with component #1.

The invention will be further illustrated by the following examples which are included as being illustrative of the invention and which should not be construed as limiting the scope thereof.

EXAMPLES

In order to ascertain the antifoulant efficacy of the compounds of the present invention, an apparatus was used that pumps process fluid (crude oil) from a Parr bomb through a heat exchanger containing an electrically heated rod. Then the process fluid is chilled back to room temperature in a water-cooled condenser before being remixed with the fluid in the bomb. The system is pressurized by nitrogen to minimize vaporization of the process fluid.

The Dual Fouling Apparatus (DFA) used to generate the data shown in Table 1 contains two heated rod exchangers that are independent except for a common pump drive transmission. In the DFA tests the rod temperature was controlled at 800° F. while testing a mid-continent crude oil. As fouling on the rod occurs, less heat is transferred to the fluid so that the process fluid outlet temperature decreases. Antifoulant protection was determined by comparing the summed areas under the fouling curves of the oil outlet temperatures for control, treated and ideal (nonfouling) runs. In this method, the temperatures of the oil inlet and outlet and rod temperatures at the oil inlet (cold end) and outlet (hot end) are used to calculate U-rig coefficients of heat transfer every 30 minutes during the tests. From these U-rig coefficients, areas under the fouling curves are calculated and summed over the tests for the control and treatments. The ideal case is represented as the summed area using the highest U-rig coefficient. Comparing the areas of control runs (averaged) and treated runs vs the ideal area in the following equation results in a percent protection value for antifoulants.

$$\frac{\text{Area (treatment)} - \text{Area (control)}}{\text{Area (ideal)} - \text{Area (control)}} * 100 = \%\ \text{protection}$$

Table 1 details the percent protections obtained on blank runs and treated runs containing varying combinations of the pentaerythritol ester of polyisobutenylthiophosphonic acid (MW polyisobutenyl moiety 1300) used as the basic antifoulant component (1), a phenylenediamine, specifically N'-phenyl-N' (1,3-dimethylbutyl)-p-phenylenediamine, used as the antioxidant component (2), tetrahydropyrimidene corrosion inhibitor (3) and the metal deactivator (4), N,N'-disalicylidene-1,2-cyclohexanediamine.

TABLE I

RESULTS-800° F. ROD TEMPERATURE
MID-CONTINENT CRUDE OIL

| | Compound(s) Added - Active, ppm | | | | |
|---|---|---|---|---|---|
| No. of Runs | (1) ppm | (2) ppm | (3) ppm | (4) ppm | Average Protection, % |
| 35 | 0 | 0 | 0 | 0 | 0 |
| 1 | 35 | 0 | 0 | 0 | 2 |
| 1 | 70 | 0 | 0 | 0 | 38 |

TABLE I-continued

| RESULTS-800° F. ROD TEMPERATURE MID-CONTINENT CRUDE OIL | | | | | |
|---|---|---|---|---|---|
| | Compound(s) Added - Active, ppm | | | | |
| No. of Runs | (1) ppm | (2) ppm | (3) ppm | (4) ppm | Average Protection, % |
| 2 | 100 | 0 | 0 | 0 | 22 |
| 1 | 125 | 0 | 0 | 0 | 16 |
| 1 | 200 | 0 | 0 | 0 | 24 |
| 5 | 250 | 0 | 0 | 0 | 47 |
| 1 | 0 | 50 | 0 | 0 | 1 |
| 2 | 0 | 100 | 0 | 0 | −12 |
| 1 | 0 | 250 | 0 | 0 | −17 |
| 1 | 0 | 0 | 100 | 0 | 12 |
| 1 | 0 | 0 | 250 | 0 | 32 |
| 1 | 0 | 0 | 0 | 50 | −12 |
| 1 | 0 | 0 | 0 | 100 | −2 |
| 1 | 0 | 0 | 0 | 250 | 24 |
| 1 | 35 | 26 | 0 | 0 | 1 |
| 1 | 35 | 0 | 70 | 0 | 33 |
| 1 | 35 | 0 | 0 | 14 | 34 |
| 1 | 35 | 26 | 70 | 0 | 45 |
| 1 | 35 | 26 | 0 | 14 | 9 |
| 1 | 35 | 0 | 70 | 14 | 37 |
| 2 | 35 | 26 | 70 | 14 | 62 |
| 1 | 70 | 26 | 70 | 0 | 28 |
| 1 | 70 | 26 | 70 | 14 | 5 |
| 1 | 70 | 52 | 125 | 28 | 59 |
| 1 | 73 | 50 | 110 | 0 | 31 |
| 1 | 100 | 26 | 70 | 0 | 34 |
| 1 | 100 | 26 | 70 | 14 | 43 |
| 1 | 146 | 100 | 220 | 0 | 62 |
| 2 | 250 | 26 | 0 | 0 | 47 |
| 1 | 250 | 78 | 0 | 0 | 56 |
| 3 | 250 | 0 | 70 | 0 | 39 |
| 2 | 250 | 0 | 0 | 14 | 22 |
| 1 | 250 | 0 | 0 | 42 | 33 |
| 2 | 250 | 26 | 70 | 0 | 76 |
| 1 | 250 | 78 | 200 | 0 | 62 |
| 1 | 250 | 26 | 0 | 14 | 8 |
| 1 | 250 | 78 | 0 | 42 | 39 |
| 1 | 250 | 0 | 26 | 14 | 39 |
| 1 | 250 | 0 | 70 | 42 | 38 |
| 2 | 250 | 26 | 70 | 14 | 41 |

The results reported in Table I were then analyzed by multiple regression in accordance with standard procedure using the computer program available on RS/l. In this multiple regression analysis, the dosages, ppm for each component, as well as the multicomponent formulations form the independent variables X (1 through 11) and were compared with the dependent variable Y (protection). In multiple regression analysis, the observed values of the dependent variable (protection level) are assumed to have come at random from a normal distribution of Y values existing in the population at the particular observed combination of independent variables. Furthermore, all such normal distributions, at all combinations of values for the dependent variable, are assumed to have the same variance. The computational procedures required for this multiple regression analysis precluded hand calculation and this was carried out using a computer program included in RS/l distributed by Bolt, Baranek and Newman, Inc. Initially, all variables with actual data were included in the model and the sums of squares and sums of cross products were calculated for the entire matrix to obtain correlation coefficients for each variable. The program suggested which independent variables fit least in the model and the process was repeated until only those variables which exhibited a 95+% significance level were left.

The results of the multiple regression appear in Table II and show that variables $X_1$ (component 1), $X_8$ (components 1+2+3) and $X_{11}$ (components 1+2+3+4) exhibit greater than 95% significance in the model. The actual multiple regression equation is also shown which is 99.99% significant. The variables exhibiting less than 95% significance and thus not included in the model are also shown in Table II. However, variables $X_3$ (component 3), $X_5$ (components 1+2), and $X_6$ (components 1+3) would be expected to approach 95% significance with additional DFA testing. This is one of several computational techniques that could be used to express formulation performance.

TABLE II

| Variable | Fitted Value | Significance Level |
|---|---|---|
| $X_1$ (1) | 0.062472 | 99.9% |
| $X_8$ (1) (2) (3) | 0.000013 | 99.3% |
| $X_{11}$ (1) (2) (3) (4) | 0.000003 | 97.8% |

Equation is:

% Protection = $0.062472\ X_1 + 0.000013\ X_8 + 0.000003\ X_{11} + 10.042113$

VARIABLES NOT IN MODEL

| Variable Name | Significance Level |
|---|---|
| $X_2$ (2) | 18% |
| $X_3$ (3) | 84% |
| $X_4$ (4) | 11% |
| $X_5$ (1) (2) | 91% |
| $X_6$ (1) (3) | 72% |
| $X_7$ (1) (4) | 17% |
| $X_9$ (1) (3) (4) | 45% |
| $X_{10}$ (1) (2) (4) | 37% |

The dosage in ppm of individual components and mixtures of (1)+(2)+(3) and (1)+(2)+(3)+(4) vs. actual protection values shown in Table 1 were compared to determine the existence of enhanced antifouling capability of the components. As shown in Table 3, individual components (1) and (3) exhibited antifoulant protection while components (2) and (4) did not at dosages up to 250 ppm. The expected protection of the 3 or 4 component compounds is the additive sum of the approximate protections for each component at the dosage actually used. By comparing the actual and expected protection values for the 3 or 4 component compounds, the difference indicates the protection level which was unexpected.

TABLE III

| Compound | Concentration ppm | % Protection Actual | % Protection Expected | Enhancement (Actual - Expected) |
|---|---|---|---|---|
| (1) | 35 | 2 | — | — |
| | 70 | 38 | — | — |
| | 100 | 21 | — | — |
| | 125 | 16 | — | — |
| | 250 | 47 | — | — |
| (2) | 50 | 1 | — | — |
| | 100 | −12 | — | — |
| (3) | 100 | 12 | — | — |
| | 250 | 32 | — | — |
| (4) | 50 | −12 | — | — |
| | 100 | −2 | — | — |
| (1) + (2) + (3) | 35 + 26 + 70 | 45 | 15 | 30 |
| | 70 + 26 + 70 | 28 | 51 | −23 |
| | 73 + 50 + 110 | 31 | 51 | −20 |
| | 100 + 26 + 70 | 34 | 34 | 0 |
| | 146 + 100 + 220 | 62 | 36 | 26 |
| | 250 + 26 + 70 | 76 | 60 | 16 |
| | 250 + 78 + 200 | 62 | 57 | 5 |
| (1) + (2) + (3) + (4) | 35 + 26 + 62 + 14 | 64 | 3 | 61 |
| | 35 + 26 + 70 + 14 | 58 | 3 | 55 |

TABLE III-continued

| Compound | Concentration ppm | % Protection Actual | % Protection Expected | Enhancement (Actual - Expected) |
|---|---|---|---|---|
| | 70 + 26 + 70 + 14 | 5 | 39 | −34 |
| | 70 + 52 + 125 + 28 | 59 | 42 | 17 |
| | 100 + 26 + 70 + 14 | 43 | 22 | 21 |
| | 250 + 26 + 70 + 14 | 41 | 48 | −7 |

Components (1), (2), (3), and (4) in Tables II and III are the same as reported for Table I.

In accordance with the patent statutes, the best mode of practicing the invention has been set forth. However, it will be apparent to those skilled in the art that many other modifications can be made without departing from the invention herein disclosed and described, the scope of the invention being limited only by the scope of the attached claims.

I claim:

1. A method for controlling the formation of fouling deposits in a hydrocarbon medium during processing thereof at elevated temperatures of from about 100° F.–1000° F. comprising dispersing within said hydrocarbon medium an antifouling amount of an effective antifoulant composition comprising an ester, alkaline earth metal salt or amine addition salt of polyalkenylthiophosphonic acid, and an additional antifouling component(s) selected from the group consisting of:

(2) an effective antioxidant compound adapted to inhibit oxygen based polymerization of said hydrocarbon, (3) a corrosion inhibiting compound or compounds, and (4) a metal deactivator compound or compounds adapted to complex with metallic impurities in said hydrocarbon medium.

2. Method as recited in claim 1 comprising feeding from about 0.5–10,000 parts of the combination of (1) and additional antifouling component(s) to said hydrocarbon medium, based upon one million parts of said hydrocarbon medium.

3. Method as recited in claim 2 comprising feeding from about 1–500 parts of the combination of (1) and additional antifouling component(s) to said hydrocarbon medium.

4. Method as recited in claim 1 wherein said compound (1) comprises a polyglycol ester of said polyalkenylthiophosphonic acid.

5. Method as recited in claim 1 wherein said compound (1) comprises a lower alkyl alcohol ($C_1$–$C_5$) ester of said polyalkenylthiophosphonic acid.

6. Method as recited in claim 4 wherein said compound (1) comprises a pentaerythritol ester of said polyalkenylthiophosphonic acid.

7. Method as recited in claim 4 wherein said compound (1) comprises a hexylene glycol ester of said polyalkenylthiophosphonic acid.

8. Method as recited in claim 5 wherein said compound (1) comprises an n-butanol ester of said compound (1).

9. Method as recited in claim 1 wherein the alkenyl moiety of said polyalkenylthiophosphonic acid has a molecular weight of between about 600 and 5,000.

10. Method as recited in claim 1 wherein said compound (1) comprises an ester, alkaline earth metal salt or amine addition salt of polyisobutenylthiophosphonic acid.

11. Method as recited in claim 10 wherein said compound (1) comprises a polyglycol ester of said polyisobutenylthiophosphonic acid.

12. Method as recited in claim 10 wherein said compound (1) comprises a lower alkyl ($C_1$–$C_5$) ester of said polyisobutenylthiophosphonic acid.

13. Method as recited in claim 11 wherein said compound (1) comprises a hexylene glycol ester of said polyisobutenylthiophosphonic acid.

14. Method as recited in claim 11 wherein said compound (1) comprises a pentaerythritol ester of said polyisobutenylthiophosphonic acid.

15. Method as recited in claim 12 wherein said compound (1) comprises an n-butanol ester of said polyisobutenylthiophosphonic acid.

16. Method as recited in claim 10 wherein the molecular weight of said isobutenyl moiety of said polyisobutenylthiophosphonic acid is within the range of between about 600 to 5,000.

17. Method as recited in claim 16 wherein the molecular weight of said isobutenyl moiety of said polyisobutenylthiophosphonic acid is about 1300.

18. Method as recited in claim 1 wherein said antioxidant (2) is present and comprises a phenylenediamine compound.

19. Method as recited in claim 18 wherein said phenylenediamine compound comprises N-phenyl-N′(1,3-dimethylbutyl)-p-phenylenediamine, N-phenyl-N′(1,4-dimethylpentyl)-p-phenylenediamine, and/or N-phenyl-N′(1,3-dimethylpropyl)-p-phenylenediamine.

20. Method as recited in claim 1 wherein said corrosion inhibitor (3) is present and comprises tetrahydropyrimidene.

21. Method as recited in claim 1 wherein said metal deactivator (4) is present and comprises N,N′-disalicylidene-1,2-cyclohexanediamine.

* * * * *